United States Patent [19]

Medland

[11] 4,185,420

[45] Jan. 29, 1980

[54] EAVESTROUGHING SYSTEM

[76] Inventor: Morson A. Medland, 175 Manor Ave., Ottawa, Ontario, Canada, K1M 0H1

[21] Appl. No.: 907,811

[22] Filed: May 19, 1978

[51] Int. Cl.[2] ..... E04B 13/00

[52] U.S. Cl. ..... 52/11; 248/48.1

[58] Field of Search ..... 52/11; 248/48.2, 48.1

[56] References Cited

U.S. PATENT DOCUMENTS

| | | | |
|---|---|---|---|
| 538,108 | 4/1895 | Freeze | 52/11 |
| 1,558,385 | 10/1925 | Meunier | 248/48.1 |
| 2,625,353 | 1/1953 | Henry | 52/11 |
| 3,091,055 | 5/1963 | Hegedusich | 52/11 |
| 4,019,290 | 4/1977 | Manty | 52/11 |
| 4,072,285 | 2/1978 | Greenwood | 52/11 |

FOREIGN PATENT DOCUMENTS

| | | | |
|---|---|---|---|
| 1293363 | 10/1948 | Australia | 52/11 |
| 1125628 | 3/1962 | Fed. Rep. of Germany | 248/48.1 |
| 1474956 | 3/1978 | France | 52/11 |
| 423172 | 4/1967 | Switzerland | 52/11 |

*Primary Examiner*—James A. Leppink
*Assistant Examiner*—Henry E. Raduazo
*Attorney, Agent, or Firm*—Gipple & Hale

[57] ABSTRACT

An eavestroughing system is provided with brackets which permit sliding movement of the eavestrough relative to the roof of a house so that the eavestrough may be moved under the eaves of the house during winter. This inhibits the accumulation of ice on the roof and reduces the damage caused thereby.

9 Claims, 4 Drawing Figures

EAVESTROUGHING SYSTEM

This invention relates to an eavestroughing or guttering system and, in particular, to a device to overcome the accumulation of ice and snow which may build up in the gutter and spread onto the roof adjoining the eavestrough or gutter. Such a buildup may eventually cause leaking or actual damage to the roof, in particular, to the singles thereof, and to the eavestrough or gutter itself. The buildup is also a potential danger to passers by because of the accumulation of a heavy unstable substance on the roof. In addition, the eavestrough or gutter may become clogged with leaves, dirt and other particles which accumulate and buildup in the gutters. These can cause water to back up and flow over the edge. This overflow of water may cause damage if the gutters are built into the cornice, for water can find its way down inside the walls of the house. The downspout may also be damaged if it becomes clogged with leaves, dirt and other particles since water which does not escape will expand on freezing and may split the downspout. The presence of rotting leaves can also cause an acidic reaction which may cause damage to a metal surface.

It is an object of the present invention to obviate or mitigate some or all of the above disadvantages.

According to the present invention there is provided a support for an eavestrough comprising a guide portion, a bracket, one end thereof being shaped to receive a gutter section, and interconnecting means interconnecting the bracket and the guide portion to permit relative movement therebetween.

According to a further embodiment of the invention there is provided an eavestroughing system comprising a plurality of supports attached to the periphery of a roof to support a gutter section, the support comprising a guide portion, a bracket having one end thereof shaped to receive the gutter section and interconnecting means interconnecting the bracket and the guide portion to permit relative movement therebetween, the gutter portion being movable from a position outside the periphery of the root to a position with the periphery of the roof.

An embodiment of the invention will now be described by way of example only with reference to the accompany drawings in which.

Figure 1:
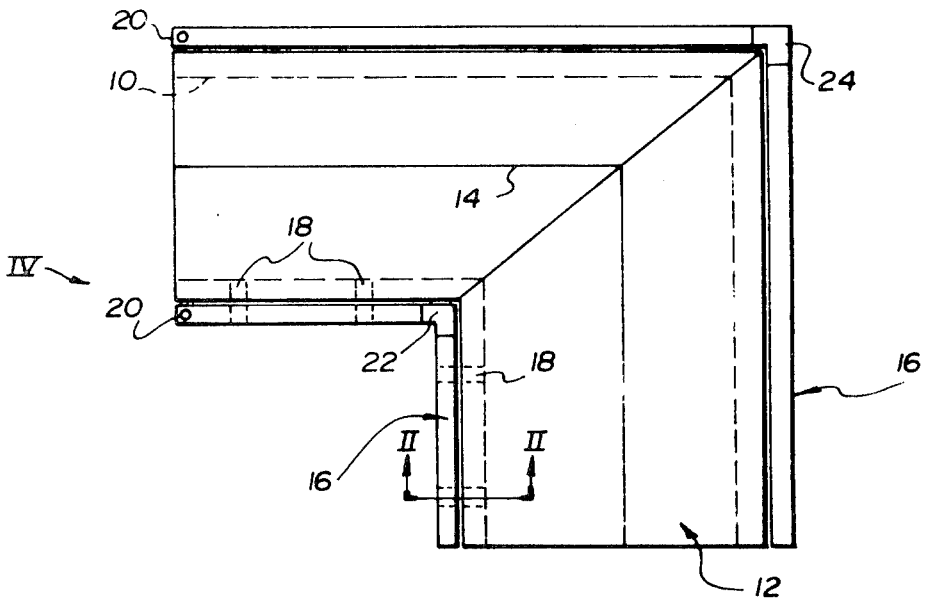
FIG. 1 is a plan view of a roof of a house.

Referring now to FIG. 1, walls 10 of a house are surrounded by a roof 12. The roof 12 slopes downwardly from a ridge 14. Eavestroughing 16 is provided at the lowermost edges of the roof 12 and is supported at appropriate positions by supports 18. Each run of eavestroughing 16 is provided with a downpipe 20 and corner pieces 22, 24 are provided to accommodate the internal and external angles of the roof line.

Figure 2:
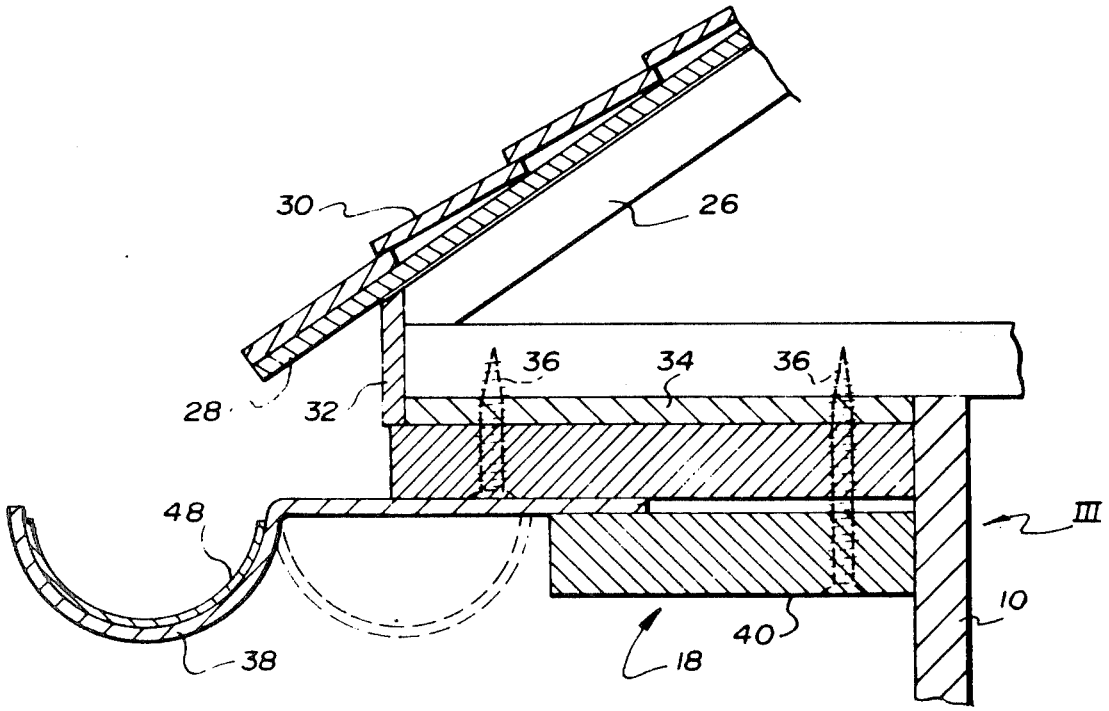
FIG. 2 is a section on the line II—II of FIG. 1.
Figure 3:
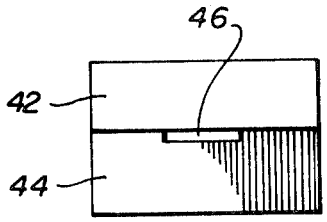
FIG. 3 is a view in the direction of arrow III in FIG. 2.

As will best be seen in FIG. 2 the wall 10 supports a plurality of roof trusses 26. Wooden cladding 28 is attached to the trusses 26 and supports shingles 30 which are laid in overlapping relationship.

A fascia 32 is mounted on the front of the trusses 26 and a soffit 34 is attached to the underside of the truses.

The supports 18 are attached through the eavesboard to the trusses by means of nails or screws as designated by reference numeral 36.

The support 18 comprises a bracket 38 and a guide portion 40. The guide portion is formed from an upper and a lower block 42, 44, respectively and a channel 46 is formed in the upper surface of the lower block and extends along the entire length thereof. The lower block 44 is shorter in length than the upper block 42 and thereby provides a recess at one end of the guide portion 40.

The bracket is formed from a strip of sheet material, preferably steel, which has a rectangular cross-section. The cross-section of the material is chosen to be a snug fit within the channel 46 and the distal end of the bracket is appropriately shaped to receive a gutter section 48.

With the bracket in the position indicated in FIG. 2 the gutter section is supported in an aligned relationship with the edge of the roof 12 and thereby collects water that may run from the shingles. The water is discharged from the gutter section into the downpipe 20 and from there into the drainage system. If the gutter section is left in this position during winter there is a possibility that continual thawing and freezing of snow will cause a buildup of ice in the gutter which may buildup to a sufficient extent to extend over the edge of the roof 12. This will then cause the shingles 30 to lift with the resultant damage to the roof. To avoid this problem the bracket 38 together with the gutter section 48 may be slid to the position indicated in dotted lines in FIG. 2. In this position the gutter section is wholly within the outer periphery of the roof 12 and consequently ice will not be able to build up within the gutter section. The bracket is free to slide within the channel 46 so that the movement of the bracket and gutter section to the position indicated in dotted lines is readily accomplished.

In order to accommodate the movement of the bracket and gutter section the corner pieces 22, 24 are detachably mounted so that they may be readily removed prior to movement of the bracket. Similarly the downpipes 20 may be detachably connected to the gutter to permit their ready removal prior to movement of the bracket.

Figure 4:
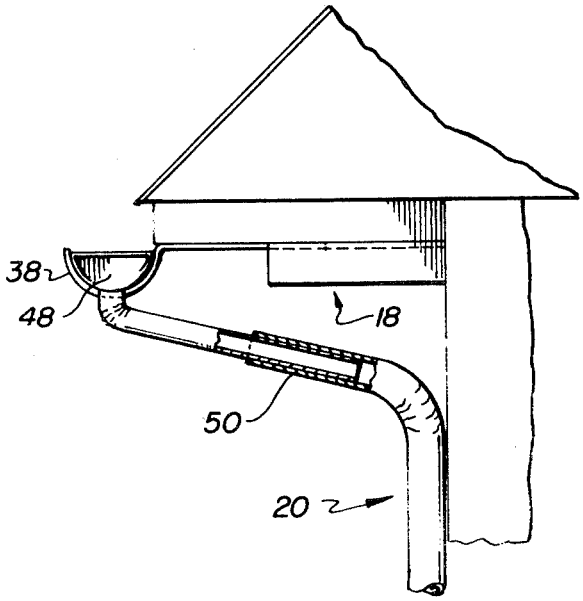
FIG. 4 is a partial view in the direction of arrow IV of FIG. 1.

A further arrangement of downpipe is shown in FIG. 4. In this arrangement the downpipe 20 is formed with a telescopic portion 50 which accommodates transverse movement of the gutter section 48. Thus in this arrangement there is no requirement to detach the downpipes.

The movement of the brackets and gutter sections from the extended position to the retracted position may readily be accomplished by manual pressure exerted either directly on the brackets or by means of an extended pole which allows the manoeuver to be completed from the ground.

Stop means may be provided on the bracket to prevent accidental removal thereof from the guide.

While the embodiment described illustrates the bracket and support having a sliding motion other arrangements to permit movement of the gutter within the periphery of the roof are contemplated. For example the bracket may be pivotally attached to the guide with removable stays to permit the bracket and gutter section to swing to a position within the periphery of the roof.

The gutter section may be of any suitable shape and may be made of any suitable material such as plastic, wood or galvanized metal. Similarly the guide may be made of any suitable material such as wood or plastic or if preferred may be fabricated from sheet metal or the like.

The embodiments of the invention in which an exclusive property or privilege is claimed are defined as follows:

1. A support member for attachment to a roof to support an eavestrough comprising a guide portion having an upper surface adapted for connection to an eave of said roof, a bracket having one end thereof shaped to receive a gutter section and another end formed as an elongate portion, interconnecting means interconnecting said bracket and said guide portion, said interconnecting means including a channel in said guide portion extending generally parallel to said upper surface and slidably receiving said elongate portion of said bracket to permit sliding movement of said elongate portion in said channel between a first position and a second position, so that in said first position said one end is supported outside the periphery of a roof and in said second position said one end is supported below said eave within the periphery of said roof.

2. A support member according to claim 1 wherein said bracket and said channel are complementary in cross-section.

3. A support member according to claim 2 wherein said bracket is formed from a strip of material having a rectangular cross-section.

4. A support member according to claim 1, 2 or 3 wherein said guide portion is formed with a recess at one end thereof to accommodate said one shaped end.

5. A support member according to claim 1 wherein said guide portion is formed from two blocks which abut along generally planar faces, said channel being provided in one of said faces.

6. A support member according to claim 5 wherein said channel extends along the entire length of said one face.

7. A support member according to claim 6 wherein said other face has a greater length then said one face.

8. An eavestroughing system comprising a plurality of support members attached to the periphery of a roof to support a gutter section, said support members comprising a guide portion having an upper surface connected to an eave of said roof, a bracket having one end thereof shaped to receive said gutter section and another end formed as an elongate portion and interconnecting means interconnecting said bracket and said guide portion, said interconnecting means including a channel in said guide portion extending generally parallel to said upper surface and slidably receiving said elongate portion of said braket to permit sliding movement of said elongate portion in said channel between a first position and a second position, whereby said gutter portion is slidable from a position outside the periphery of the roof when said bracket is in said first position to a position within the periphery of said roof when said bracket is in said second position.

9. An eavestroughing system according to claim 8 wherein said guide portion includes a recess to accommodate said gutter section.

* * * * *